US006168152B1

(12) United States Patent
Ratz

(10) Patent No.: US 6,168,152 B1
(45) Date of Patent: Jan. 2, 2001

(54) COAXIAL PADDLE WHEEL FAN AND GRIPPER CONVEYOR SPROCKET WITH INDEPENDENT DRIVING MEANS FOR EACH

(75) Inventor: Holger Ratz, Frankenthal (DE)

(73) Assignee: Koenig & Bauer Aktiengesellschaft, Wurzburg (DE)

( * ) Notice: Under 35 U.S.C. 154(b), the term of this patent shall be extended for 0 days.

(21) Appl. No.: 09/269,762

(22) PCT Filed: Oct. 4, 1997

(86) PCT No.: PCT/DE97/02278

§ 371 Date: Apr. 8, 1999

§ 102(e) Date: Apr. 8, 1999

(87) PCT Pub. No.: WO98/16455

PCT Pub. Date: Apr. 23, 1998

(30) Foreign Application Priority Data

Oct. 12, 1996 (DE) ..... 196 42 130

(51) Int. Cl.[7] ..... B65H 29/04; B65H 29/20

(52) U.S. Cl. ..... 271/204; 271/315; 271/82; 271/187

(58) Field of Search ..... 271/315, 82, 204, 271/187, 3.24, 275

(56) References Cited

U.S. PATENT DOCUMENTS

| | | | | |
|---|---|---|---|---|
| 3,390,508 | * | 7/1968 | Heimlicher | 271/187 |
| 4,203,590 | | 5/1980 | Blessing . | |
| 4,205,837 | | 6/1980 | Von Heine et al. . | |
| 5,120,049 | | 6/1992 | Fischer . | |
| 5,261,656 | * | 11/1993 | Gutov et al. | 271/243 |
| 5,380,000 | * | 1/1995 | Ohno | 271/204 |
| 5,611,530 | * | 3/1997 | Maresse et al. | 271/315 |

FOREIGN PATENT DOCUMENTS

| | | | | |
|---|---|---|---|---|
| 2811467A1 | | 10/1978 | (DE) . | |
| 2849273A1 | | 7/1979 | (DE) . | |
| 3817804C1 | | 10/1989 | (DE) . | |
| 336062 | * | 10/1989 | (EP) | 271/204 |
| 606550 | * | 7/1994 | (EP) | 271/82 |
| 147759 | * | 6/1988 | (JP) | 271/315 |
| 427625 | | 12/1966 | (SE) . | |
| 1395527 | * | 5/1988 | (SU) | 271/82 |

* cited by examiner

*Primary Examiner*—Donald P. Walsh
*Assistant Examiner*—Daniel K Schlak
(74) *Attorney, Agent, or Firm*—Jones, Tullar & Cooper, P.C.

(57) ABSTRACT

A device is used to transfer printed products from the paddle wheel pockets of a paddle wheel or a delivery fan. A gripper chain carries a plurality of grippers which remove the printed products from the pockets without damaging them. A gripper chain drive wheel and the paddle wheel or wheels have a common axis of rotation but are driven separately from each other.

12 Claims, 3 Drawing Sheets

COAXIAL PADDLE WHEEL FAN AND GRIPPER CONVEYOR SPROCKET WITH INDEPENDENT DRIVING MEANS FOR EACH

FIELD OF THE INVENTION

The present invention relates to a device for transferring printed products from paddles of a rotating paddle or delivering form to grippers of a gripper chain type of printed product transport device.

DESCRIPTION OF THE PRIOR ART

A device is known from CH-PS 427 625, wherein the printed products are positively removed from the paddle wheels by means of a chain equipped with grippers. Here, several paddle wheels as well as a chain wheel are fastened on a common shaft and therefore rotate at the same speed.

Shortly after the printed products have been taken up by the grippers, in this prior art device the paddle wheel pockets are turned out of the area of the printed products held in the grippers. In this case, it is disadvantageous that the portion of the printed product located in the gripper jaws can be damaged while being turned out of the bottom of the paddle wheel pocket. This applies in particular to thick printed products.

SUMMARY OF THE INVENTION

The object of the present invention is directed to producing a device for transferring printed products out of a paddle wheel.

In accordance with the invention, this object is attained by the provision of a gripper chain or printed product traction device. The axes of rotation of the paddle wheel or delivery fan, and of the traction device drive wheel are located on a common axis of rotation. The paddle wheel or wheels, and the traction device drive wheel can be driven independently of each other.

The advantages which can be attained by the present invention rest in particular in that, after the transfer of a printed product to a gripper, the bottom of a paddle wheel pocket moves away from the front edge of the printed product before the paddle wheel pocket is turned out of the area of the printed product. In this way, the damage-free removal of the printed product from the paddle wheels and its transfer to a chain conveyor is assured by a compact and simple construction of the paddle wheel and chain drive.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
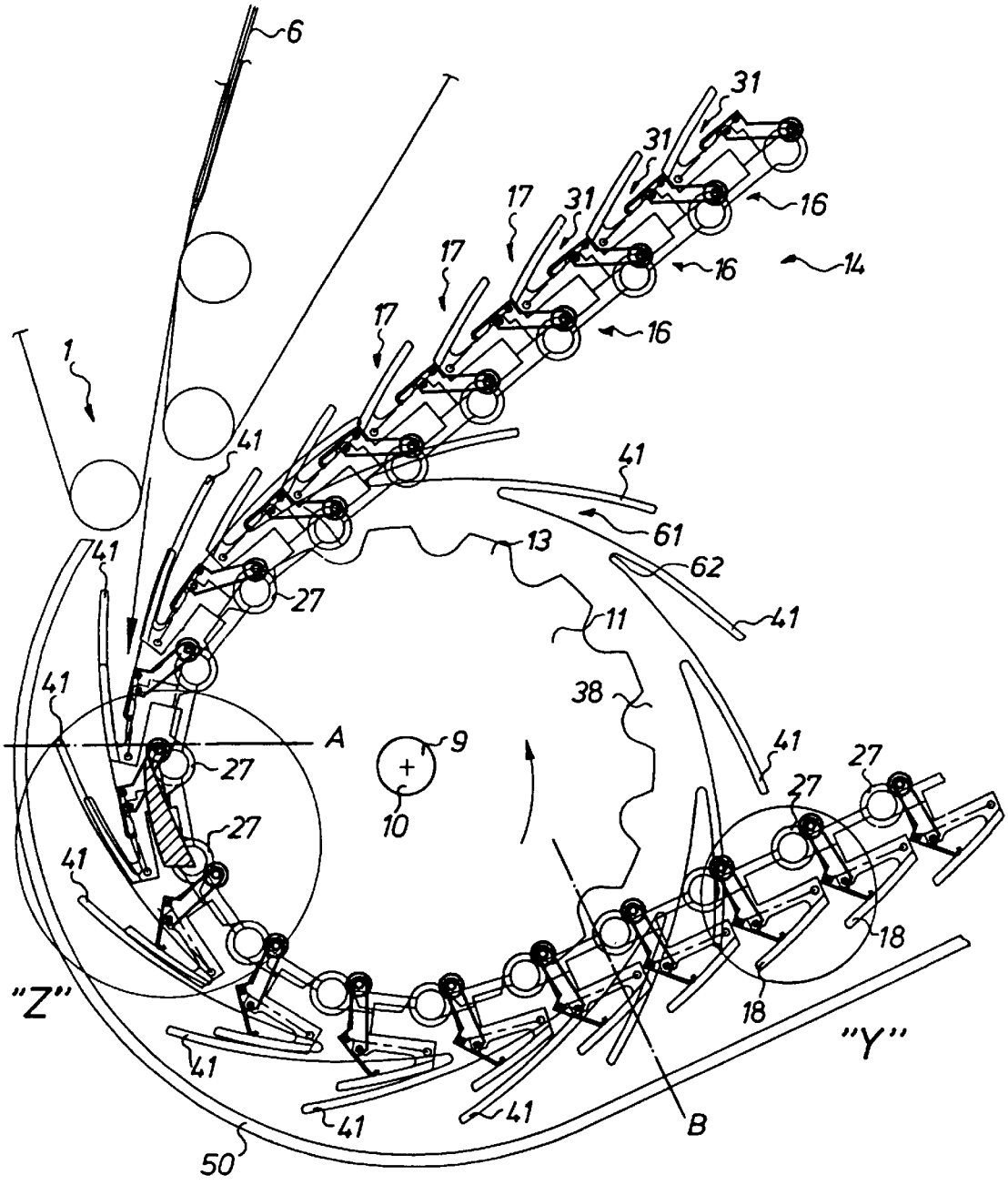
FIG. 1, a schematic representation of the lateral view of a device for removing printed products, along a line I—I in FIG. 4.
Figure 4:
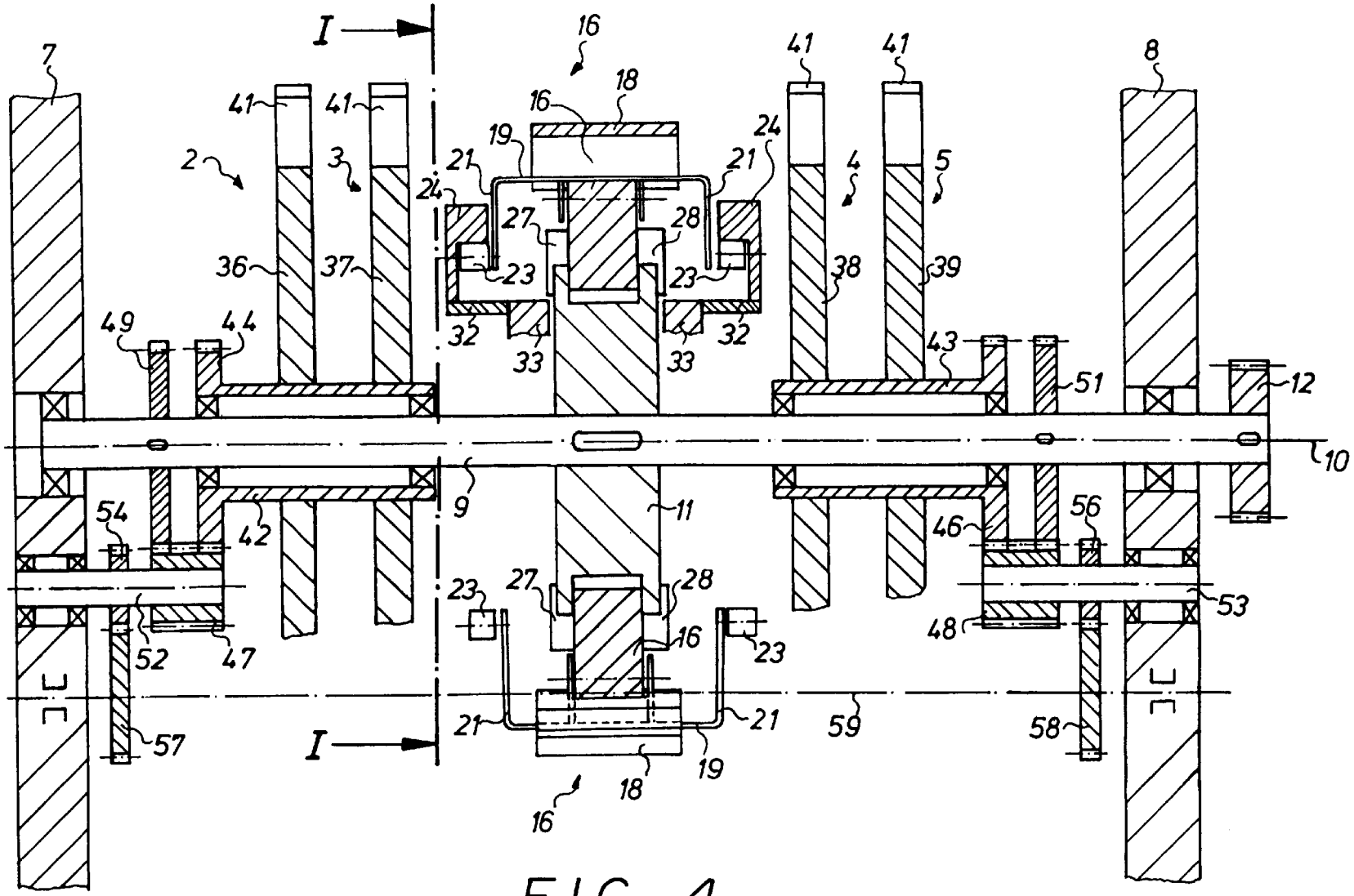
FIG. 4, a longitudinal section through a device in accordance with FIG. 1.

Four synchronously rotatable paddle wheels 2, 3, 4, 5, for example, which are spaced apart from each other in an axial direction of shaft 9, are arranged underneath a belt system 1 arriving from a folding device, for example, as seen in FIGS. 4 and 1. A chain wheel 11 is fastened, so as to be fixed against relative rotation by means of wedges, and is centered between the center paddle wheels 3, 4 on the shaft 9 having an axis of rotation 10. Shaft 9 is seated for rotation in two lateral frames 7, 8. The shaft 9 is driven by means of a drive wheel 12 which is, for example, located outside of the lateral frame 8 all as seen in FIG. 4. The number of revolutions of the drive wheel 12, and therefore of the shaft 9, can be, for example 2/15th of the number of revolutions of the plate cylinder of the rotary printing press. On its circumference, the chain wheel 11 has fifteen teeth 13, for example, as depicted in FIG. 1. The teeth 13 engage a gripper chain 14. The ride walls or flanks between each of the teeth of the chain wheel 11 are in interlocking contact with chain rollers 27, 28 located on each chain link 16 as may be seen in FIGS. 1 and 2.

Figure 2:
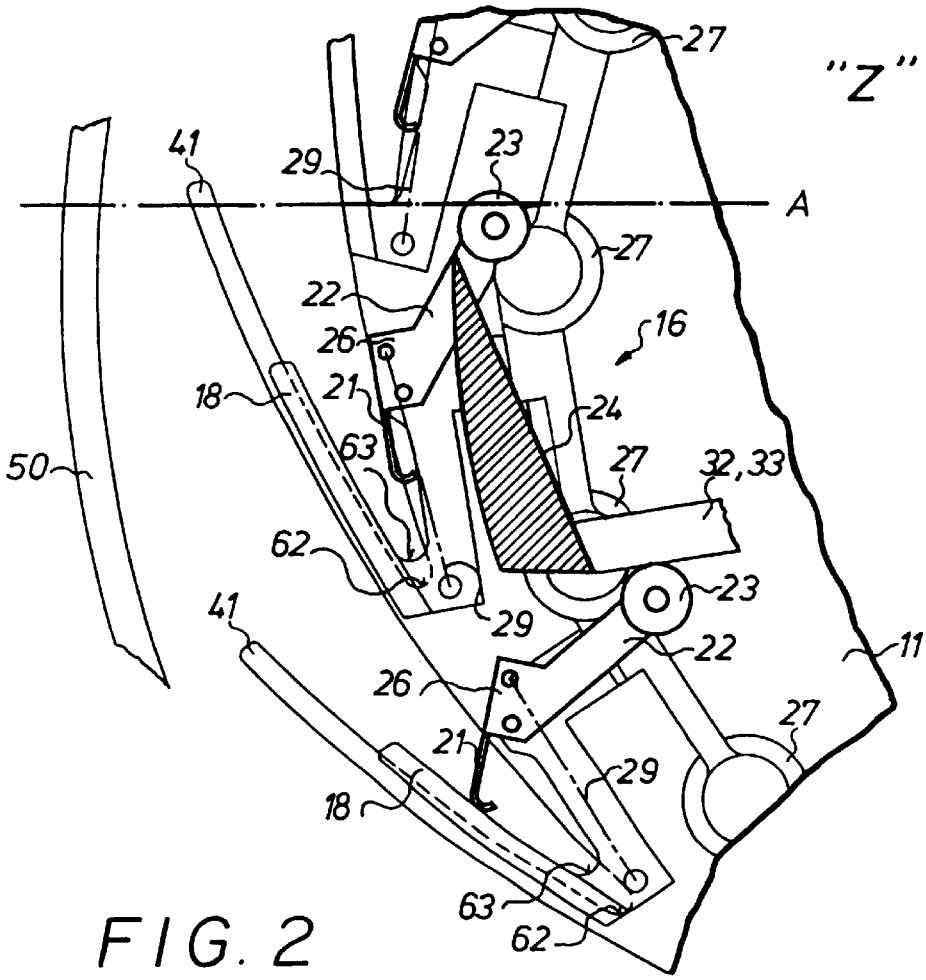
FIG. 2, an enlarged representation of a detail "z" with the entry location of a printed product in accordance with FIG. 1.
Figure 3:
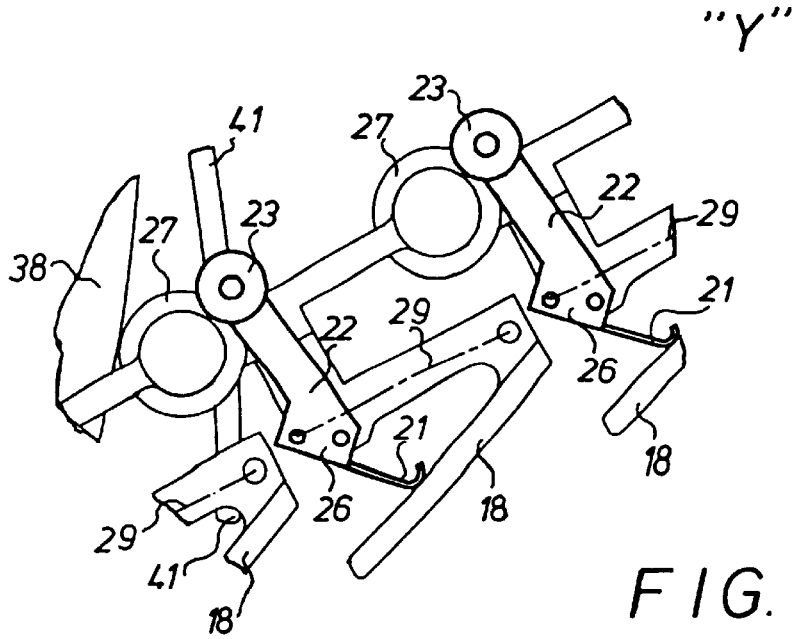
FIG. 3, an enlarged representation of a detail "y" with the separation line between the paddle wheel and the gripper in accordance with FIG. 1.

Each chain link 16 supports a gripper generally at 17, which each is respectively consisting of one fixed clamping jaw 18, and one pivotable clamping jaw 19. The pivotable clamping jaw or cheek 19 is supported by two levers 21, which are hinged on both sides of the chain link 16. Each such lever 21 is a component of a three-piece lever arm, which is respectively hinged on both sides of the chain link 16. A second lever arm 22 respectively supports a cam roller 23 to be actuated on a control cam 24 fixed in place on the frame all as shown in FIG. 2. On its end, a third lever arm 26 has one point of the attachment or application of force of a tension spring 29, whose abutment is located in the vicinity of the bottom of the gripper jaw 31 of each gripper 17. The pivotable clamping jaw or cheek 19 can be pivoted by the action of the tension spring 29 from a stable open position through an extended dead center position into a stable closed position by means of actuating the second lever arm 22 on the control cam 24.

The control cam 24 can be fastened, for example by means of a holder 32 of a U-shaped cross section, on a mounting fixed on the frame, for example a guide disk 33. However, two levers 22, rollers 23, holders 32 for control cams and guide disks 33 can also be provided.

Each one of the four paddle wheels 2 to 5 rotates around the axis of rotation 10 and has a hub 36, 37, 38, 39, each of which has a number of paddles 41 on its exterior circumference. The number of paddles 41 is less than the number of teeth 13 located on the circumference of the chain wheel 11. For example there may be provided fifteen teeth 13 and fourteen paddles 41. The means that the pitch $t_s$ of the paddle wheels 2 to 5 is respectively greater than the pitch $t_k$ of the chain wheel 11. The paddle wheel hubs 36, 37, or respectively 38, 39 are arranged, fixed against relative rotation, and spaced apart from each other, on individual bushings or with several hubs on each bushing for example two wheels—each on a bushing 42, 43, or all together. The bushings 42, 43 are seated coaxially and rotatably on the shaft 9 to the left and right of the chain wheel 11 as shown in FIG. 4.

On its end most adjacent to its associated one of the lateral frames, each bushing 42, 43 is connected, fixed against relative rotation, with a bushing gear wheel 44, 46, each of which meshes with an intermediate gear wheel 47, 48 of at least twice the width of the bushing gear wheel 44, 46. Each intermediate gear wheel 47, 48 also is in engagement with a shaft wheel 49, 51 arranged, fixed against relative rotation, on the shaft 9.

Each bushing wheel 44, 46, which fixed on a bushing 42 or 43, repectively has a lesser number of teeth, for example 70 teeth, with respect to a greater number of teeth, for example 75 teeth, of each shaft gear wheel 49, 51 fixed on the shaft. In order to have the same axial distance in spite of this, the bushing gear wheels 44, 45 are positively corrected, and the shaft gear wheels 49, 51 are negatively corrected.

The paddle wheels 2 to 5, or respectively the bushings 42, 43, rotate at a higher number of revolutions $n_s$ in respect to the number of revolutions $n_k$ of the chain wheel 11, which revolves at a lower number of revolutions $n_k$. The number of revolutions $n_s$ in $n_k$ have a relationship such as m/14 to m/15, wherein "m" means the number of grooves around a plate cylinder circumference. By means of the higher number of revolutions of the paddle wheels 36 to 39, it is achieved, that the paddles 41 lead the grippers 17 by a defined amount and gently move away from the folded products. The lower belt of the gripper chain 14 is surrounded with guide rods 50 starting at the transfer location for the printed products 6.

The bushing gear wheels 44, 46 for driving the paddle wheels 2, 3, 4, 5, and the shaft gear wheels 49, 51 fastened on the shaft 9 are respectively in engagement with the intermediate gear wheel pinion 47, or respectively with the intermediate gear wheel 48. Thus gears 44 and 49 mesh with pinion 47 and gears 46 and 51 mesh with pinion 48.

The intermediate gear wheels or pinions 47, 48 are each respectively seated or supported on their assosiated lateral frame 7 or 8, by means of a shaft 52, 53. A driven gear wheel 54, 56 is located on each shaft 52, 53 and is arranged fixed against relative rotation. Each driven gear wheel 54, 56 meshes with a synchronizing gear wheel 57, 58. Both synchronizing gear wheels 57, 58 are respectively arranged on a synchronizing shaft 59 for synchronizing the numbers of revolution of both bushings 42, 43. The synchronizing shaft 59 is also seated fixed in the lateral frames 7 and 8 on both sides.

The functioning of the device for transferring printed products in accordance with the present invention is described as follows. Printed products 6, preferably folded, and coming from the belt system 1 of the folding device, reach the bottom 62 of the paddle wheel pocket 61 at an inlet location A of the counterclockwise rotating paddle wheel 2 to 5. An opened gripper jaw 31 of a gripper 17 is simultaneously located at this inlet location A in a position in which the bottom 63 of the gripper jaw 31 is in a position which is axis-parallel in relation to the shaft 9. By means of this, the fold edges, in particular those of thick folded products of, for example, four millimeters, have an even support surface. After the entry of the printed product 6 into the paddle wheel pocket 61, or respectively into the gripper jaw 31, the second lever 22 supporting the roller 23 moves against the control cam 24, which is fixed on the frame. Because of this, the pivotable clamping jaw 19 is pressed against the printed product 6. Thus, the printed product 6 is clamped in place in the gripper jaw 31.

Because of the higher number of revolutions and therefore also the greater circumferential speed of the paddle wheels 2 to 5, the bottom 62 of the paddle wheel pocket 61 moves away from the bottom 63 of the gripper jaw 31. Therefore a movement of the paddle wheel pockets 61 takes place at a separating line B of the movement direction of the gripper chain 61, which makes damage to the front edge of the printed product 6 impossible.

Displacement of the inlet location A can take place by means of turning the shaft drive wheel 12. Because of the gearing between the gear teeth 46, 51, or respectively 44, 49, a difference between the bottom 62 of the paddle wheel pocket 61 and the bottom of the gripper jaw 31 is created here. This difference can be compensated in that the shaft 53 with the gear wheel 47, or respectively the shaft 52 with the gear wheel 47, are exchanged for a differential gear. Such a gear can be designed as a harmonic drive gear or a sliding gear.

The traction mechanism 14 can be embodied in different ways: for example as a chain, toothed belt or a flat belt with drive openings at regular distances.

The invention is not limited to the arrangement of paddle wheels 2 to 5 on bushings 42, 43, which are located on the driveshaft 9 for the traction mechanism drive wheel 11—for example a chain wheel—. Instead, the traction mechanism drive wheel 11 can also be arranged in a rotatable and drivable manner on a combined bushing which can encompass bushings 42 plus 43, on which all paddle wheels 2 to 5 are then seated.

While a preferred embodiment of a device for transferring printed products in accordance with the present invention has been set forth fully and completely hereinabove, it will be apparent to one of skill in the art that a number of changes in, for example the type of printing and folding devices being used, the number of pages of printed product, and the like may be made without departing from the true spirit and scope of the present invention which is accordingly to be limited only by the following claims.

What is claimed is:

1. A device for the transfer of printed products comprising:

a rotatable paddle wheel having a plurality of circumferentially spaced paddles, said paddles defining printed product receiving pockets, said paddle wheel being rotatable about a paddle wheel axis of rotation;

a printed product gripper assembly including a plurality of grippers carried by a traction mechanism driven by a traction drive wheel, said traction drive wheel being rotatable about a traction drive wheel axis of rotation, said paddle wheel axis of rotation and said traction drive wheel axis of rotation being arranged on a common axis of rotation; and means for driving said paddle wheel and said traction drive wheel independently of each others.

2. The device of claim 1 wherein said paddle wheel has a number of paddles and further wherein said traction drive wheel has a number of driving teeth, said number of paddles being less than said number of driving teeth.

3. The device of claim 2 wherein a pitch of said paddle wheel is greater than a tooth pitch of said traction drive wheel.

4. The device of claim 1 wherein a speed of rotation of said paddle wheel is greater than a speed of rotation of said traction drive wheel.

5. The device of claim 1 further including a common bushing and at least two of said paddle wheels, said at least two paddle wheels being supported by said common bushing.

6. The device of claim 5 wherein said bushing is adapted to be driven.

7. The device of claim 5 wherein said traction drive wheel is supported by a traction drive wheel driveshaft and further wherein said common bushing is seated on said driveshaft.

8. The device of claim 5 wherein said traction drive wheel is rotatably and drivably seated on said common bushing.

9. The device of claim 1 wherein said traction mechanism is a chain.

10. The device of claim 1 wherein said traction mechanism is a toothed belt.

11. The device of claim 1 wherein said traction mechanism is belt-shaped with teeth and holes having the same longitudinal distances.

12. The device of claim 1 wherein said paddle wheel is driven at a number of revolutions higher than a number of revolutions of said traction drive wheel.

* * * * *